US006984336B2

(12) United States Patent
Altmann et al.

(10) Patent No.: US 6,984,336 B2
(45) Date of Patent: Jan. 10, 2006

(54) CLOTHES TREATMENT FOR DRY WRINKLE RESISTANCE

(75) Inventors: Markus Wilhelm Altmann, Brussels (BE); Bruno Albert Jean Hubesch, Neerijse-Huldenberg (BE); Heidi Simonne Mariette Soyez, Oostende (BE); Jürgen Detering, Limburgerhof (DE); Ulrich Steuerle, Heidelberg (DE)

(73) Assignee: The Procter & Gamble Company, Cincinnati, OH (US)

( * ) Notice: Subject to any disclaimer, the term of this patent is extended or adjusted under 35 U.S.C. 154(b) by 4 days.

(21) Appl. No.: 10/922,613

(22) Filed: Aug. 20, 2004

(65) Prior Publication Data

US 2005/0015887 A1 Jan. 27, 2005

Related U.S. Application Data

(63) Continuation of application No. 10/037,849, filed on Oct. 19, 2001, now abandoned.

(30) Foreign Application Priority Data

Oct. 27, 2000 (EP) ..... 00870251

(51) Int. Cl.

| | |
|---|---|
| ***D06B 1/02*** | (2006.01) |
| ***D06B 1/04*** | (2006.01) |
| ***C11D 7/22*** | (2006.01) |
| ***C11D 7/26*** | (2006.01) |

(52) U.S. Cl. ..... 252/8.91; 510/327; 510/328; 510/475; 510/476; 510/499; 510/504; 510/521; 510/513; 8/196

(58) Field of Classification Search ..... 510/327, 510/328, 336, 337, 475, 476, 499, 504, 521, 510/513; 252/8.61, 8.91; 8/115.51, 196
See application file for complete search history.

(56) References Cited

U.S. PATENT DOCUMENTS

| | | | | |
|---|---|---|---|---|
| 3,671,305 | A * | 6/1972 | Brown et al. | 442/93 |
| 4,008,196 | A | 2/1977 | Matsuda et al. | |
| 4,534,892 | A | 8/1985 | Suzuki et al. | |
| 5,068,324 | A | 11/1991 | O'Lenick, Jr. | |
| 5,695,677 | A | 12/1997 | Silvester et al. | |
| 5,968,404 | A * | 10/1999 | Trinh et al. | 252/8.91 |
| 5,981,456 | A | 11/1999 | Tartakovsky et al. | |
| 6,001,343 | A | 12/1999 | Trinh et al. | |
| 6,239,091 | B1 | 5/2001 | Tartakovsky et al. | |
| 6,491,840 | B1 * | 12/2002 | Frankenbach et al. | 252/8.91 |
| 6,506,372 | B1 | 1/2003 | Dubief et al. | |
| 6,554,869 | B2 * | 4/2003 | Aubay et al. | 8/137 |
| 2001/0056058 | A1 | 12/2001 | Panandiker et al. | |
| 2002/0006890 | A1 | 1/2002 | Sunder et al. | |
| 2002/0132748 | A1 | 9/2002 | Altmann et al. | |
| 2003/0153481 | A1 | 8/2003 | Kischkel et al. | |
| 2004/0014631 | A1 | 1/2004 | Weber et al. | |

FOREIGN PATENT DOCUMENTS

| | | |
|---|---|---|
| WO | WO 96/15309 A2 | 5/1996 |
| WO | WO 00/58428 A1 | 10/2000 |

* cited by examiner

*Primary Examiner*—Gregory R. Del Cotto
(74) *Attorney, Agent, or Firm*—David V. Upite

(57) ABSTRACT

The invention concerns the treatment of clothes for dry wrinkle resistance, in particular in-wear wrinkle resistance. The clothes are treated with an amphoteric polymer and secured in the desired configuration, preferably during a process of ironing.

8 Claims, No Drawings

CLOTHES TREATMENT FOR DRY WRINKLE RESISTANCE

CROSS REFERENCES TO RELATED APPLICATIONS

This application is a continuation of U.S. patent application Ser. No. 10/037,849, filed Oct. 19, 2001, now abandoned, the disclosure of which is incorporated by reference herein.

TECHNICAL FIELD

The invention relates to the treatment of clothes for dry wrinkle resistance, and in particular in-wear wrinkle resistance. The clothes are treated with an amphoteric polymer. The amphoteric polymer is preferably provided to the clothes during a process of ironing.

BACKGROUND

Treatments of clothes to confer to them various properties have been extensively discussed in the art. In particular, an area of constant research is the area of wrinkle reduction. That is, worn clothes are generally wrinkled to a lesser or greater degree, and the process of laundering generally increases the wrinkling of clothes. Thus, chemicals have been provided to diminish the wrinkling of clothes. The use of such chemicals, combined with the traditional process of ironing provides for clothes which are clean and dewrinkled.

However, such clean and dewrinkled clothes will re-wrinkle as soon as they are worn, and before that while they are stored waiting to be worn. Thus, the dewrinkling of clothes described above is at best a very temporary achievement. It is thus an object of the present invention to provide a solution to the problem of dry wrinkle formation, i.e., the formation of wrinkles when dry clothes are stored waiting to be worn, and while clothes are worn (i.e., in-wear wrinkle formation).

To our knowledge, the prior art has not addressed this particular problem. It has now been found that this problem can be addressed by treating the clothes with an amphoteric polymer, and securing the fabrics in the desired configuration, preferably by ironing them. Without wishing to be bound by theory, it is believed that the dipoles which are present in the amphoteric polymers will "lock" together the polymers, thereby forming a network which prevents the formation of wrinkles.

SUMMARY OF THE INVENTION

In one embodiment, the present invention encompasses a process of treating clothes, where clothes are treated with an amphoteric polymer and secured in the desired configuration.

In a second embodiment, the present invention encompasses a fabric treating composition comprising an amphoteric polymer, formulated at or around the isoelectric point of said polymer. That compositions preferably comprises a perfume.

In a third embodiment, the present invention encompasses the use of an amphoteric polymer for the treatment of clothes, for the benefit of dry-wrinkle resistance, in particular in-wear wrinkle resistance.

Finally, the present invention also encompasses an article of manufacture comprising an amphoteric polymer, and usage instructions to treat clothes with said polymer and secure the clothes in the desired configuration.

DETAILED DESCRIPTION OF THE INVENTION

The Benefit:

In the present invention, it has been discovered that amphoteric polymers can be used to treat clothes so as to provide the benefits of dry wrinkle resistance, i.e. the resistance to the formation of wrinkles when fabrics are dry, waiting to be worn, and while fabrics are being worn (i.e. in-wear wrinkle resistance). This benefit is to be distinguished from the well-known and extensively discussed benefit of dewrinkling. Indeed, a particular compound may have the ability to dewrinkle clothes without conferring to fabrics the ability to resist to the formation of new wrinkles, as the dry clothes await to be worn, or while they are worn. In the present invention, a fabric treated with an amphoteric polymer will show fewer wrinkles than an untreated fabric after storage, and after having been worn.

The Amphoteric Polymer:

Suitable for use herein are amphoteric polymers, i.e., polymers comprising at least one anionic moiety and one cationic moiety, and optionally a non-ionic moiety. The anionic moiety comprises a group which is a deprotonated anion of an acid group when the polymer is dissolved/dispersed in water at a pH of about 7 and which can be protonated to form a nonionic acid group when the polymer is dissolved/dispersed in water at an acidic pH. Representative examples of such groups include carboxylate, phosphonate, phosphate, phosphite, sulfonate, sulfate groups, and combinations thereof.

Optionally, each moiety may be further complexed with a separate, cationic counterion other than hydrogen. When used, representative examples of such counterions, include $Na^+$, $Li^+$, $K^+$, $NH4^+$ or combinations thereof.

The cationic moiety comprises a protonated cation when the polymer is dissolved/dispersed in water at a pH of about 7 or below and can be deprotonated to a nonionic form when the polymer is dissolved/dispersed in water at a basic pH. Alternatively, the cationic moiety comprises a group which is a quaternized group.

Representative examples of the protonated group include the ammonium functionality, phosphonium functionality, sulfonium functionality, and combinations thereof. The term ammonium refers to a moiety including a nitrogen atom linked to a plurality of moieties (either H, alkyl or aryl groups) by four bonds when dissolved/dispersed in water at a pH of 7. The term sulfonium refers to a moiety including a sulfur atom linked to three other moieties (either H, alkyl or aryl groups) when dispersed in water at a pH of about 7. The term phosphonium refers to a moiety including a phosphorous atom linked to four other moieties (either H, alkyl or aryl groups) when dispersed in water at a pH of about 7.

Examples of the ammonium, phosphonium and sulphonium functionality may be presented by the following formulae, respectively:

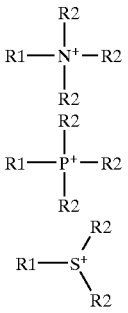

In these formulae, R1 represents the polymer backbone and R2 represents hydrogen, alkyl or aryl substituents. In case the cationic moiety exists as a quaternized group, all R2 groups represents alkyl or aryl substituents, excluding hydrogen.

As an option, each such second functional group may be further complexed with a separate, anionic counterion. When used, representative examples of such counterion, include chlorides, sulfates, carbonates, nitrates, formiates, perchlorates, or combinations thereof.

Optionally, amphoteric polymers herein comprise a non-ionic moiety. A preferred class of amphoteric polymers for use herein are polymers composed of both cationic and anionic vinylmonomers.

Suitable anionic vinylmonomers for use herein include salts of acrylic acid, methacrylic acid, crotonic acid, maleic acid, fumaric acid, itaconic acid and vinylsulphonic acid. Suitable cationic vinylmonomers for use herein include salts of unsaturated amines such as the hydrochloride salt of vinylamine, salts of N,N'-dialkylaminoalkyl (meth) acrylates and N,N'-dialkylaminoalkyl (meth) acrylamides such as the hydrochloride salt of dimethylaminoethylmethacrylate (DMAEMA.HCl) or dimethylaminopropylacrylamide; alkyl quaternized aminoalkyl (meth) acrylates and aminoalky (meth) acrylamides such as trimethylammoniumethyl methacrylatechloride, trimethylammoniumpropyl acrylamidemethylsulfate, alkyl quaternized polar vinyl heterocyclics such as based on pyridinium or imidazolium such as alkylvinylpyridinium, alkylvinylimidazolium and mixtures thereof.

Optionally, a non-ionic comonomer can be incorporated, such as amides and imides of organic acids, such as acrylamide, N,N-dialkylacrylamide, N-t-butylacrylamide, maleimides, vinylformamide, aromatic vinyl monomers such as styrene, vinyltoluene, t-butylstyrene; polar vinyl heterocyclics such as vinyl pyrrolidone, vinyl caprolactam, vinyl pyridine, vinylimidazole; low molecular weight unsaturated hydrocarbons and derivatives such as ethylene, propylene, butadiene, cyclohexadiene, vinylchloride and mixtures thereof.

A preferred polymer of this class is based on poly(vinylamine-co-acrylic acid), in molar ratios varying between 1:100 to 100:1, preferably 90:10 to 40:60. Polymers of this class preferably have a molecular weight between 20.000 and 5.000.000 preferably between 30.000 and 1.000.000, more preferably between 50.000 and 300.000.

A second class of polymers which are preferred for use herein are anionically modified polyethyleneimines. Examples of anionically modified polyethyleneimines include polyethyleneimines grafted with acrylic acid, methacrylic acid, maleic acid, fumaric acid, crotonic acid, itaconic acid, or carboxymethylated.

The processes for the preparation of anionically modified polyethyleneimines are well known. They can be prepared by reacting α,β-unsaturated carboxylic acids (C═C—COOH) like acrylic or maleic acid with polyethyleneimine (Michael-type reaction) or by carboxymethylation. The carboxymethylation is carried out by reacting polyethyleneimine either with chloroacetic acid or with formaldehyde and sodium cyanide and subsequent saponification of the resultant aminonitrile. The latter procedure is well-known as the "Strecker Synthesis".

Polymers of this class have a degree of substitution of between 5 and 95, preferably 20 and 80, and a molecular weight between 5000 and 2 000 000, preferably 20 000 and 1 000 000.

In the present invention, the amphoteric polymers can be provided to the clothes in amounts of from $1\times10^{-7}$ g/g fabric to 0.3 g/g fabric, preferably from $1\times10^{-5}$ g/g fabric to 0.1 g/g fabric; more preferably from $1\times10^{-3}$ g/g fabric to $1\times10^{-2}$ g/g fabric.

The Domestic Treatment, and the Respective Compositions and Articles of Manufacture:

In the present invention, the amphoteric polymers can be provided to clothes in a variety of ways.

In a first embodiment of the process, the amphoteric polymer can be provided to the clothes in a "through the wash treatment", which is generally achieved with a detergent composition which will contain conventional detergency ingredients as well as the amphoteric polymer. The detergent can be a granular, solid, i.e. a block or a tablet, or a liquid. It is not necessary to describe here in detail suitable detergency ingredients, in particular detergent surfactants, and detergent compositions used in the context of "through-the-wash" treatments have been described in WO 00/053,710; WO 00/053,709; U.S. Pat. Nos. 6,127,329; 6,103,685; WO 00/043,478; WO 00/037,609; WO 00/043,478 and WO/0037604. The description of detergent compositions in those two documents is incorporated herein by reference. In this embodiment, the amphoteric polymer is provided to the fabric during the conventional laundering process. In a detergent composition, the amphoteric polymer will be present in amounts ranging from 0.05% to 10%; preferably from 0.1% to 5% so as to be provided to clothes in the required amounts.

In a second embodiment of the domestic process, the amphoteric polymer is provided to the clothes together with the last rinse in the laundering process. In this embodiment, the amphoteric polymer can be added to the rinse water as a standalone product, or it can be added to the rinse water as a component of a fabric conditioner. Fabric conditioners have been disclosed in WO 00/24853, WO/9201773 and EP 300 525. The description of fabric conditioners in those three documents is incorporated herein by reference. In a fabric conditioner, or as a standalone product the amphoteric polymer will be present in amounts ranging from 0.1% to 10%; preferably from 0.3% to 5%; more preferably from 0.1% to 3% so as to be provided to clothes in the required amounts.

In a third and preferred embodiment of the domestic process, the amphoteric polymer is provided to the clothes after the laundering process, when the clothes are wet, damp or dry. In this embodiment, the amphoteric polymer can be provided to the fabrics by a variety of means, such as brushing, spraying, or releasing from a substrate in an automatic clothes dryer. When sprayed, which is the preferred embodiment herein, the amphoteric polymer can be sprayed from a sprayer or an aerosol as a standalone product, or from an iron. When dispensed from an iron, the amphoteric polymer is either introduced in and dispensed from the iron's water tank as in EP 629 736, or from a separate reservoir in the iron as in U.S. Pat. No. 3,160,969, or by means of a cartridge to be inserted in the iron for the dispensing of its content as in WO99/27176. If designed as a standalone product to be used as a spray, the composition will generally comprise the amphoteric polymer in amounts from 0.01% to 30%; preferably from 0.1% to 20%; more preferably from 0.5% to 10%. If the amphoteric polymer is to be released from a substrate in an automatic clothes dryer, the substrate will generally comprise the amphoteric polymer in amounts of from 0.1% to 20%; preferably from 2% to 20%.

In all embodiments, the amphoteric polymer is preferably formulated as an aqueous solution. Besides water and amphoteric polymer, and the various ingredients required for the specific embodiment concerned (i.e. detergency surfactants for detergents, fabric softeners for fabric conditioners, etc . . . ), the aqueous solution may comprise other ingredients. In particular, it is essential that the amphoteric polymer be provided to the clothes at or around its isoelectric point, in order to ensure that the locking mechanism described above does indeed happen to a sufficient extent. Therefore, if the polymer is provided to the clothes in a "through-the-wash treatment, or in the rinse, it is essential that the composition comprises a buffer such that the polymer will be delivered to the clothes in an environment having a pH at or around its isoelectric point. Suitable buffers may be glycine hydrochloride/glycine; acetic acid/sodium acetate; formic acid/sodium formate; $KH_2PO_4$/$Na_2HPO_4$; ammonium chloride/ammonium; glycine/sodium glycinate; $NaHCO_3$/$Na_2CO_3$, citric acid/sodium citrate; succinic acid/sodium hydroxide; $KH_2PO_4$/sodium hydroxide; boric acid/KCl/sodium hydroxide.

Furthermore, in a preferred embodiment of the invention the amphoteric polymer is formulated in a composition together with a lubricant, as in co-pending application EP 99870223.7. The compositions herein may of course further comprise minor ingredients, mainly perfume.

In the invention, it is essential that the fabrics are provided with the amphoteric polymer and that they be secured in the desired configuration. By "secured in the desired configuration", it is meant that the fabrics should be secured in the configuration in which the user wants it to be "locked". Usually, fabrics will be secured in the most wrinkle-free possible configuration. Therefore, the fabrics are usually stretched, or even preferably ironed. It is not critical to perform the two steps (providing the amphoteric polymer and securing the clothes in the desired configuration) in any particular order. It is only critical that the fabrics be secured in the desired configuration before the polymer network is "dry-locked". In a most preferred embodiment, the amphoteric polymer is sprayed onto the clothes before and/or during and/or after the clothes are ironed. In other words, the amphoteric polymer is used as an ironing product.

The present invention also encompasses articles of manufacture comprising the amphoteric polymer and usage instructions to use the polymer for the benefit of dry winkle resistance. Those instructions will depend on the specific embodiment which is chosen. If the polymer composition is used as an ironing product, it is preferably contained in a manual trigger sprayer container, or in an aerosol container, or in an iron. The container is labeled with instructions, or accompanied with a leaflet bearing instructions to use the composition during the ironing process. Specifically, the composition is sprayed onto fabrics and the fabrics are ironed. If the polymer is delivered to clothes in the last rinse of a normal laundry cycle, the composition is contained in a container which is labeled with instructions, or accompanied with a leaflet bearing instructions to use the composition during the last rinse of a normal laundry cycle, and to secure the clothes in the desired configuration. If the polymer is formulated in a detergent composition, the composition is contained in a container which is labeled with instructions, or accompanied with a leaflet bearing instructions to use the composition in a normal laundry cycle, and to secure the clothes in the desired configuration.

EXAMPLES

The invention is illustrated by the further examples, in which percentages are on a weight basis unless otherwise stated.

Example 1

Synthesis of Aqueous Poly(vinylamine-co-sodium acrylate)

This amphoteric copolymer was prepared by free-radical polymerization of vinylformamide and sodium acrylate in water, followed by acid or alkaline hydrolysis of the resultant vinylformamide/sodium acrylate copolymer. To start the polymerization conventional radical initiators such as azo- or peroxo-compounds were used. Molecular weights of the amphoteric copolymers were controlled by adding appropiate amounts of initiator or of chain transfer agents, especially mercapto compounds (e.g. mercaptoethanol).

Volatile impurities were subsequently removed by steam distillation. After hydrolysis the pH-value of the polymeric solution was adjusted to 6–7 by adding either mineral or organic acids (e.g. hydrochlorid acid or formic acid) or sodium hydroxide. Polymers were characterized by determination of their molecular weight (method: small-angle light scattering) before hydrolysis.

Polymers which were made according to this synthesis route were:

- Poly(vinylamine-co-sodium acrylate), molar monomer ratio 70:30, Mw=240 kDalton.
- Poly(vinylamine-co-sodium acrylate), molar monomer ratio 60:40, Mw=225 kDalton.
- Poly(vinylamine-co-sodium acrylate), molar monomer ratio 40:60, Mw=245 kDalton.

Example 2

Synthesis of Carboxymethylated Polyethyleneimine

Polyethyleneimine (Mw 750000) was reacted in water with appropiate amounts of formaldehyde and sodium cyanide to achieve a degree of conversion of 30%. The resultant aminonitril was subsequently saponified with NaOH. A polymeric solution was obtained with 30% active material and a degree of carboxymethylation of 32%.

Example 3

Amphoteric Polymer in a Spray-On Compositons

| | Composition A | Composition B |
|---|---|---|
| Mirasil ADM-E[1] | 5% | — |
| Ultratex SW[2] | — | 2.5% |
| Poly(acrylate-co-vinylamine)[3] | 2% | |
| -Carboxymethylated polyethylenimine[4] | — | 1.25% |
| Silwet L 7200[5] | 3% | — |
| Radiasurf 7137[6] | — | 5% |
| Silwet L 77[7] | 0.75% | 1% |
| Velustrol P-40[8] | 2.25% | — |
| Emulsifier[9] | 0.6% | 1.25% |
| Preservative | 3 ppm | 3 ppm |
| Perfume | 0.5% | 1% |
| Water | Balance | Balance |

[1]Microemulsified linear aminosilicone from Rhodia (34% active)
[2]Microemulsified linear aminosilicone from Ciba (14% active)
[3]Any of the copolymers of vinylamine and acrylic acid as described in the synthesis procedure above in example 1 (20% active)
[4]Polymer of example 2
[5]Polyalkylene oxide polysiloxane from Crompton (100% active)
[6]Polyethoxylated (20 moles) sorbitan monolaureate from Fina (100% active)
[7]Polyalkylene oxide polysiloxane from Crompton (100% active)
[8]Oxidized polyolefin wax from Hoechst (41% active)
[9]CAE 10, coconut alcohol condensed with an average of 10 moles of ethylenoxide from Clariant (100% active)

Each composition is contained in a manual trigger sprayer container, or in an aerosol container, or in an iron. The container is labeled with instructions, or accompanied with a leaflet bearing instructions to use the composition during the ironing process. Specifically, the composition is sprayed onto fabrics and the fabrics are ironed. The fabrics are less prone to dry-wrinkle formation than other fabrics which were ironed without having been sprayed with the exemplified composition.

Example 4

Amphoteric Polymer in a Fabric Conditioner

| | Composition A |
|---|---|
| Rewoquat V3282[1] | 20 |
| Poly(acrylate-co-vinylamine)[2] | 7 |
| $CaCl_2$ | 0.15 |
| Perfume | 0.75 |
| Dye solution | 0.025 |
| HEDP[3] | 0.02 |
| HCl | 0.02 |
| Water | Balance |

[1]DEEDMAC Diethylester dimethylammonium chloride from Crompton (85% active)
[2]Any of the co-polymers of vinylamine and acrylic acid as described in the synthesis procedure above in example 1 (20% active)
[3]Hydroxyethylidene-1,1-diphosphonic acid from Albright and Wilson (59% active)

This composition is used to treat fabrics in the last rinse of a normal laundry cycle. The composition is contained in a container which is labeled with instructions, or accompanied with a leaflet bearing instructions to use the composition during the last rinse of a normal laundry cycle. The fabrics are then dried and ironed. Those fabrics are less prone to dry-wrinkle formation than other fabrics which were ironed without having been conditioned with the exemplified composition.

Example 5

Amphoteric Polymer in a Detergent

| | Composition A | Composition B |
|---|---|---|
| LAS | 8 | 6 |
| AO | 0.5 | — |
| TAE-11 | 1 | — |
| C13–15EO7 | — | 3.75 |
| C16–20 Fatty acid | — | 1 |
| STPP | 24 | 23 |
| Silicate 1.6 | 8.0 | — |
| Smectite clay | 2.5 | — |
| Copolymer AA/MA | 1.6 | — |
| Glycerol | — | 5 |
| Sodium borate | — | 2.0 |
| DTMA | 3.8 | — |
| HFA | 1.5 | — |
| CMC | 0.4 | — |
| Optical brightener | 0.23 | — |
| EDTA | 0.2 | — |
| STS | 0.65 | — |
| Perborate | 20.0 | — |
| Poly(acrylate-co-vinylamine) | 2.0 | 0.75 |
| TAE-5 | 0.5 | — |
| Enzymes | 0.5 | 0.5 |
| Photobleach activator | 25 ppm | — |
| Copper-EDTA | 30 ppm | — |
| SRS I | 2.7 | — |
| Perfume/water/sodium sulfonate/perfume | Balance | Balance |

The abbreviations for the individual ingredients of the examples have the following meaning:

LAS: Sodium salt of linear dodecyl benzene sulfonate from Condea (96% active)

AO: C12–14 alkyl dimethylamine oxide from Albright and Wilson (32% active)

TAE-5: Tallow alcohol ethoxylated with about 5 moles of ethylene oxide from Witco (100% active)

TAE-11: Tallow alcohol ethoxylated with about 11 moles of ethylene oxide from Witco (100% active)

STPP: Sodium tripolyphosphate from Rhône-Poulenc (100% active)

Copolymer AA/MA: copolymer of acrylic acid 40 mole % and maleic acid 60 mole % from BASF (30% active)

CMC: Sodium salt of carboxymethylcellulose from Sigma (100% active)

HFA: hydrogenated C16–22 fatty acid from Clariant (100% active)

DTMA: Ditallow methylamine from Clariant (100% active)

Smectite clay: Natural smectite having $CaCO_3$ ion-exchange capacity of 95 meq/100 g clay from R.T. Vanderbilt Comp. (100% active)

STS: toluene sulfonate from Albright and Wilson (100% active)

EDTA: Sodium salt of ethylene diamine tetra-acetate from BASF (100% active)

Perborate: $NaBO_3.H_2O_2.\ 3H_2O$ from Solvax Interox (100% active)

Photobleach activator: Mixture of sulfonated tetra- and trisulfonated zinc phtalocyamine in a ratio of tetra to trio of approximately 20:1 from Ciba (100% active)

Poly(acrylate-co-vinylamine): Any of the co-polymers of vinylamine and acrylic acid as described in the synthesis procedure above in example 1 (20% active)

SRS I: Prilled suds regulating system consisting of a) 77.5% STPP; b) 22.5% active; 13.5% paraffin oil, 6% paraffin wax (MP 70° C.); 3% amorphous hydrophobic silica.

Enzymes: Mixture of proteases and amylases in a ratio of 1:1 from Novo $C_{x-y}EO_n$: $C_{x-y}$ alcohol ethoxylated with n moles of ethylene oxide from BASF (100% active).

What is claimed is:

1. A method of dry-wrinkle resisting clothing comprising the step of applying a fabric treating composition comprising a poly(vinylamine-co-acrylic acid) polymer, wherein the vinylamine and acrylic acid monomers are present in a molar ratio of from about 90:10 to about 40:60 to said clothing.

2. The method according to claim 1, further comprising a step of ironing.

3. The method according to claim 1, wherein said step of applying said composition comprises spraying said composition.

4. The method according to claim 1, wherein said step of applying said composition comprises delivering said composition during a rinse of a laundry cycle.

5. A method of in-wear wrinkle resisting clothing comprising the step of applying a fabric treating composition comprising a poly(vinylamine-co-acrylic acid) polymer, wherein the vinylamine and acrylic acid monomers are present in a molar ratio of from about 90:10 to about 40:60 to said clothing.

6. The method according to claim 5, further comprising a step of ironing.

7. The method according to claim 5, wherein said step of applying said composition comprises spraying said composition.

8. The method according to 5, wherein said step of applying said composition comprises delivering said composition during a rinse of a laundry cycle.

* * * * *